United States Patent [19]

Meisel

[11] Patent Number: 4,752,663

[45] Date of Patent: Jun. 21, 1988

[54] COUNTER-TOP MICROWAVE OVEN WITH HORN AND DIFFUSING LENS

[75] Inventor: Nicholas Meisel, Epone, France

[73] Assignee: Quindicum Limited, Dublin, Ireland

[21] Appl. No.: 21,632

[22] Filed: Mar. 4, 1987

[30] Foreign Application Priority Data

Mar. 6, 1986 [IE] Ireland ..... 593/86

[51] Int. Cl.[4] ..... H05B 6/72

[52] U.S. Cl. ..... 219/10.55 F; 219/10.55 A; 333/230

[58] Field of Search ..... 219/10.55 F, 10.55 E, 219/10.55 R, 10.55 A; 333/230

[56] References Cited

U.S. PATENT DOCUMENTS

| | | | |
|---|---|---|---|
| 2,480,682 | 8/1949 | Stiefel | 219/10.55 R |
| 2,856,497 | 10/1958 | Rudenberg | 219/10.55 E |
| 2,888,543 | 5/1959 | Haagensen | 219/10.55 A |
| 3,715,551 | 2/1973 | Peterson | 219/10.55 A |
| 3,740,514 | 6/1973 | Anderson | 219/10.55 |
| 3,855,440 | 12/1974 | Staats et al. | 219/10.55 F |
| 4,157,464 | 6/1979 | Smith et al. | 219/10.55 R |
| 4,640,280 | 2/1987 | Sterzer | 219/10.55 F X |

FOREIGN PATENT DOCUMENTS

| | | | |
|---|---|---|---|
| 0014121 | 8/1980 | European Pat. Off. | 219/10.55 F |
| 0051569 | 5/1982 | European Pat. Off. | 219/10.55 F |
| 965594 | 5/1957 | Fed. Rep. of Germany . | |
| 1014118 | 8/1952 | France . | |
| 664926 | 1/1952 | United Kingdom . | |
| 1231316 | 5/1971 | United Kingdom . | |

*Primary Examiner*—Philip H. Leung

*Attorney, Agent, or Firm*—Curtis, Morris & Safford

[57] ABSTRACT

A microwave oven the rectanguloid heating chamber 6 of which has at least two dimensions less than a wavelength of the energy supply thereto and capable of heating between 60–100 grams of food to an edible temperature in 30 seconds or less is provided. The oven comprises a housing 1 coupled to an energy source 2 by way of a coaxial cable 3 and a waveguide 4. The waveguide 4 has a horn 5 providing the transition to the chamber 6 encased by the housing 1. The larger end of the horn 5 feeds into the chamber 6 while the smaller end is connected to the waveguide 4. A lens essentially comprising a laminate assembly of dielectric material plates 11,12 carrying a prism 11 directed into the waveguide 4 is positioned between the horn 5 and the chamber 6. The chamber 6 has a volume of about 0.00168 cubic meters and the power input of the oven is between 600 and 1200 watts.

9 Claims, 2 Drawing Sheets

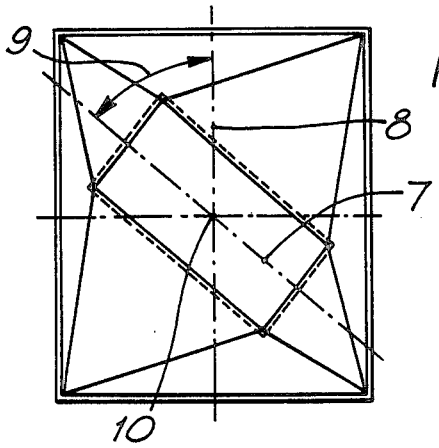
FIG. 2.
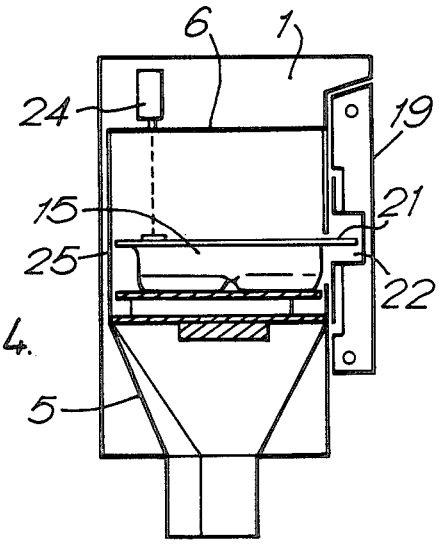
FIG. 4.
FIG. 3.
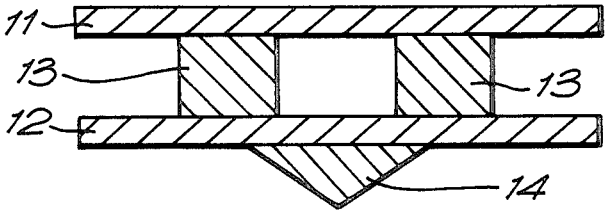

COUNTER-TOP MICROWAVE OVEN WITH HORN AND DIFFUSING LENS

This invention relates to a microwave oven, and particularly to a mircrowave oven for use in heating proprietary snack foods.

Microwave ovens are well known for use in dometstic kitchens, commercial kitchens, restaurants, cafes and the like, for cooking food or re-heating pre-cooked food.

It is known that in order to obtain a good temperature distribution in an article being heated in a microwave oven, it is necessary to provide a substantially uniform electromagnetic field distribution in the heating chamber of the oven from the microwave energy supplied thereto. The bigger the size of the heating chamber the greater the number of modes in a given frequency range can be provided therein, and the greater the number of modes, the better the energy distribution in the chamber.

For this reason, microwave ovens are generally provided with chambers rectanguloid in shape, and having at least two dimensions greater than several wavelengths of the energy to be supplied thereto.

At the authorised I.S.M. frequency of 2450 MHz, that is a wavelength of approximately 12.3 cm, an acceptable multimode chamber should be, for example, at least 30 cm deep and 35 cm wide.

In order to improve the operation of microwave ovens it is known to use so-called mode stirrers comprising metal fans rotating in the heating chamber in order to improve the electromagnetic field distribution in the chamber, and also to move an article being heated within the chamber, for example on a rotary support, in order to obtain a more uniform temperature distribution in the article.

The use of such measures requires a chamber of a relatively large size able to contain a mode stirrer fan and/or a rotary support, such size also being advantageous in helping to obtain uniform heating for the operational reasons discussed above.

However, in certain circumstances where space is limited and where only single items of, for example, proprietary snack food, are to be heated, for example in public house bars, there is a need for a microwave oven of relatively small size and high efficiency.

According to one aspect of this invention there is provided a microwave oven comprising a housing encasing a chamber to receive an article to be heated, and means to supply microwave energy to the chamber, in which the energy is supplied to the chamber from a remote source by way of a waveguide, the energy passing from the waveguide to the chamber by way of a lens serving to diffuse the energy into an article to be heated when located in the chamber.

Preferably the chamber is rectanguloid in shape and has at least two dimensions less than a wavelength of the energy to be supplied thereto.

According to another aspect of this invention there is provided a microwave oven comprising a housing encasing a chamber to receive an article to be heated, and means to supply microwave energy to the chamber from a remote source, in which the chamber is substantially rectanguloid in shape and has at least two dimensions less than a wavelength of the energy to be supplied thereto.

An oven according to this invention supplied with 600 to 1200 watts of energy is able to bring 60 to 100 grammes of food to an edible temperature in 30 seconds or less, the oven having, for example, a chamber with a volume of 0.009 cubic meters as compared with a volume of 0.02 to 0.03 cubic meters for a conventional oven.

The housing of the oven of this invention can be of relatively small size enabling it to be located, for example, on a public house bar or the counter of a cafe, while the energy source is located remote from the housing at a more convenient position. This advantage can be even greater if the energy source is coupled to the waveguide by means of a coaxial cable.

This invention will now be described by way of example with reference to the diagrammatic drawings, in which:

FIG. 2 is a top view of the waveguide horn of the oven of FIG. 1;

FIG. 3 is a sectional view of a lens used in the oven of FIG. 1; and

FIG. 4 is a sectional side view showing details of part of the oven of FIG. 1.

Figure 1:
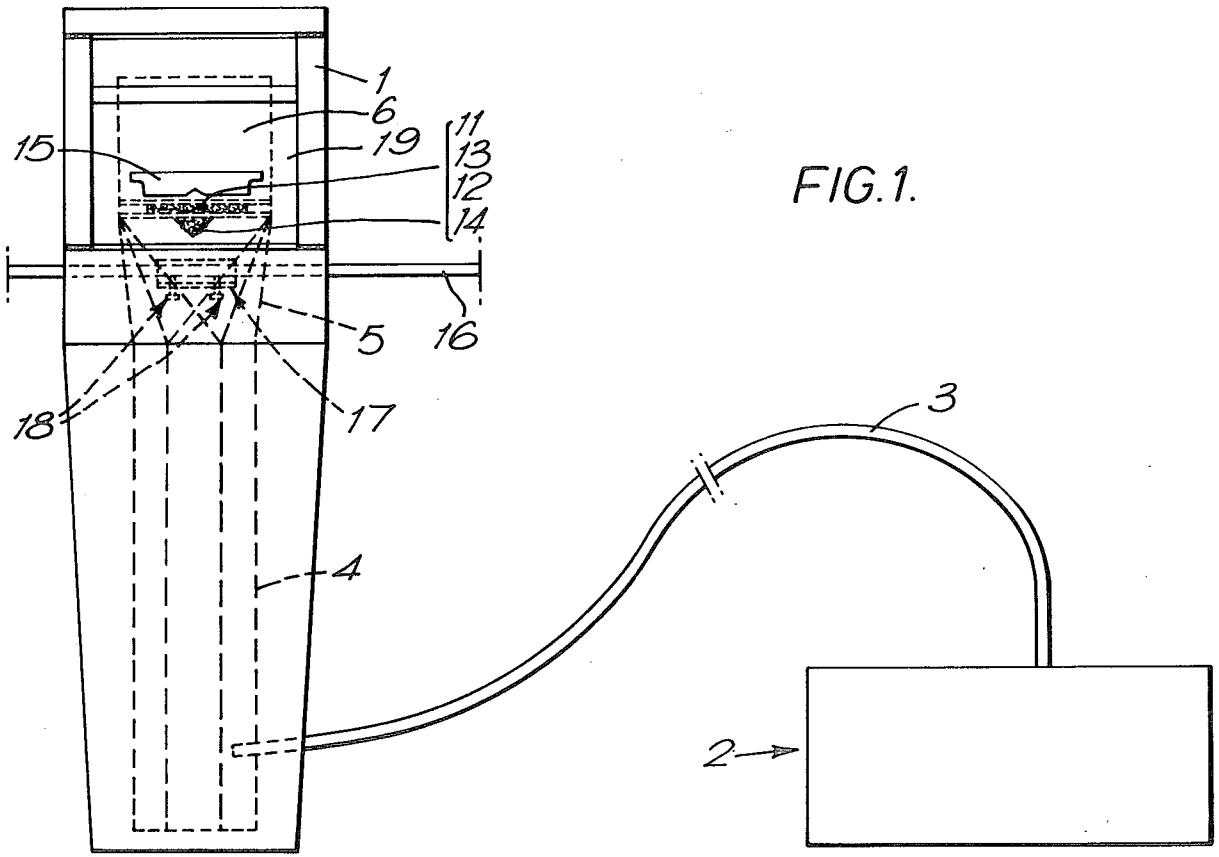
FIG. 1 is a front elevational view of an oven according to the invention.

Referring to the drawings, the oven comprises a housing 1 coupled to an energy source 2 by way of a coaxial cable 3 and a waveguide 4, the waveguide 4 having a horn 5 providing the transition to a rectanguloid chamber 6 encased by the housing 1. The larger end of the horn 5 feeds into the chamber 6 while the small end is connected to the waveguide 4. As shown in FIG. 2 the major axis 7 of the rectangular opening at the upper end of the horn 5 lies at an acute angle 9, preferably approximately 50°, to the major axis 8 of the bottom of the chamber 6. Thus, the horn 5 has the shape of a truncated irregular pyramid twisted about its vertical axis 10. Such a horn 5 provides a turning movement to the energy supplied to the chamber 6 thus minimising the reflected power.

A lens, shown in FIG. 3, is positioned between the horn 5 and the chamber 6, the lens comprising a laminated assembly of two low loss dielectric material rectangular plates 11 and 12 sandwiching between them two smaller but thicker rectangular plates 13. The lower plate 12 carries a triangular section elongate dispersing prism 14 mounted along the major axis of the plate 12. The total thickness of the plates 11, 12 and 13 is preferably greater than one quarter of a wavelength of the energy to be supplied to the chamber 6, but smaller than one half such wavelength.

The plates 11, 12 and 13 and prism 14 can be made of polytetrafluorethylene or polypropylene. The number of plates 13 and their position as well as the dimensions of plates 11, 12 and 13, is determined by the shape of an article to be heated in the chamber 6, and by the material from which the plates are made.

An article 15 to be heated is placed in the chamber 6 on the upper plate 11 of the lens.

The housing 1 is shown secured to a surface 16 by means of a clamp 17 which is welded to the horn 5 and has clamping screws 18.

As shown in FIG. 4, the housing 1 has a door 19 provided with energy seals and safety devices (not shown) of conventional type.

The open side of the chamber 6 closed by the door 19 is shaped to allow only articles 15 of a certain shape and below a certain size to be introduced into the chamber 6.

The article 15 shown has a projecting lip 21 and the door 19 is formed with a recess 22 which receives the lip 21 when the door 19 is closed. The lip 21 projects from the chamber 6 when the door 19 is open, thus facilitating removal of the article 15 from the housing 1.

The oven includes means to prevent operation thereof other than when an article 15 to be heated is located in the chamber 6, this means comprising a light or infra-red emitting and analysing device 24 mounted in the top of the housing 1 and a reflector 25 mounted on the article 15. When an article 15 is present in the chamber 6, rays from the device 24 are reflected from the reflector 25 and the device 24 responds to receipt of the reflected rays by enabling operation of the oven. In the absence of an article 15, rays reflected from the housing 1 or an incorrect article without a reflector 25, will not enable operation.

The housing 1 of the oven described above can have outside dimensions of 195×240×200 millimeters, ie. a volume of 0.009 cubic meters, with the dimensions of the chamber 6 being 120×140×100 millimeters, ie. a volume of 0.00168 cubic meters. Such an oven with a power input of 800 to 1200 watts can heat a 60 to 100 gramme proprietary snack article from ambient temperature to 70° C. within 20 to 30 seconds with an acceptable temperature distribution in the article.

I claim:

1. A counter-top microwave oven comprising a housing defining an internal rectanguloid chamber for receiving an article to be heated; a source of microwave energy of a given wavelength located externally of the housing; a waveguide for supplying the microwave energy from the source to the chamber, the waveguide terminating in a horn which opens onto one rectangular side of the chamber; and a lens at the opening of the horn serving to diffuse the energy from the horn into an article to be heated in the chamber, each of at least two dimensions of the chamber being less than the wavelength of the microwave energy supplied to the chamber by the waveguide.

2. An oven as claimed in claim 1, in which the energy source is coupled to the waveguide means by a coaxial cable.

3. A microwave oven as claimed in claim 1, in which the lens comprises a laminated assembly of dielectric material plates carrying an elongated dispersing prism of triangular section on the side facing the horn.

4. An oven as claimed in claim 3, in which said laminated assembly comprises two outer rectangular plates and at least one smaller but thicker rectangular plate sandwiched between them.

5. A microwave oven as claimed in claim 1, in which the waveguide has a rectangular cross-section, and the horn has a rectangular opening at the chamber whose major axis is at an angle to the major axis of the cross-section of the waveguide.

6. A microwave oven as claimed in claim 5, in which said angle is approximately 50°.

7. A microwave oven as claimed in claim 1 wherein the chamber is closable by a door the inner surface of which is formed with a recess to receive part of an article in the chamber to be heated.

8. A microwave oven according to claim 1, wherein the horn opens into the bottom of the chamber, and the lens serves as a base for supporting the said article in the chamber in use.

9. A microwave oven according to claim 8, wherein the horn opening and lens are substantially coextensive with the bottom of the chamber.

* * * * *